US008215030B2

(12) United States Patent
Bowen et al.

(10) Patent No.: US 8,215,030 B2
(45) **Date of Patent: *Jul. 10, 2012**

(54) OVERSHOE

(75) Inventors: David Bowen, Binghamton, NY (US); Christopher Cataldo, Endicott, NY (US)

(73) Assignee: 311 Industries, Inc., Endicott, NY (US)

( * ) Notice: Subject to any disclaimer, the term of this patent is extended or adjusted under 35 U.S.C. 154(b) by 932 days.

This patent is subject to a terminal disclaimer.

(21) Appl. No.: 11/815,469

(22) PCT Filed: Feb. 3, 2006

(86) PCT No.: PCT/US2006/003953

§ 371 (c)(1),
(2), (4) Date: Aug. 19, 2008

(87) PCT Pub. No.: WO2006/084185

PCT Pub. Date: Aug. 10, 2006

(65) Prior Publication Data

US 2008/0301974 A1 Dec. 11, 2008

Related U.S. Application Data

(63) Continuation-in-part of application No. 11/050,099, filed on Feb. 3, 2005, now Pat. No. 7,188,438.

(51) Int. Cl.
*A43B 3/10* (2006.01)
*A43B 3/12* (2006.01)

(52) U.S. Cl. ..... 36/7.1 R; 36/58.5; 36/138; 36/7.5

(58) Field of Classification Search ..... 36/7.1 R, 36/7.2–7.5, 58.5, 58.6, 138
See application file for complete search history.

(56) References Cited

U.S. PATENT DOCUMENTS

| | | | |
|---|---|---|---|
| 11,947 | A | 11/1854 | Pease |
| 369,766 | A | 9/1887 | Barney |
| 395,271 | A | 12/1888 | Fry et al. |
| 426,707 | A | 4/1890 | Pederson |
| 875,144 | A | 12/1907 | Bourn |
| 879,306 | A | 2/1908 | O'Sullivan |
| 2,268,435 | A | 12/1941 | Zucker |
| 2,436,234 | A | 2/1948 | Stein |
| 2,602,724 | A | 7/1952 | Batchelor |

(Continued)

FOREIGN PATENT DOCUMENTS

CA 2597043 8/2006

OTHER PUBLICATIONS

International Search Report and Written Opinion dated Jun. 8, 2006 issued in related International Patent Application No. PCT/US0603953.

*Primary Examiner* — Marie Patterson
(74) *Attorney, Agent, or Firm* — Grossman, Tucker, Perreault & Pfleger, PLLC

(57) ABSTRACT

An overshoe that covers a footwear structure for protecting a walking surface. The overshoe includes a base and an upstanding portion, which extends around at least a portion of the base. A protrusion extends inwardly from an inner surface of the upstanding portion. The protrusion engages the footwear structure for releasably retaining the overshoe to the footwear structure.

19 Claims, 17 Drawing Sheets

U.S. PATENT DOCUMENTS

| | | | | |
|---|---|---|---|---|
| 2,825,155 | A | 3/1958 | Hines | |
| 2,860,425 | A | 11/1958 | Jackson | |
| 3,006,084 | A | 10/1961 | Le Compte | |
| 3,283,423 | A | 11/1966 | Shovee | |
| 5,056,240 | A | 10/1991 | Sherrill | |
| 6,189,239 | B1 | 2/2001 | Gasparovic et al. | |
| 6,301,739 | B1 | 10/2001 | Cazaux | |
| 6,374,449 | B1 | 4/2002 | Jolly | |
| 6,467,192 | B1 | 10/2002 | Egtvedt | |
| 6,557,203 | B2 | 5/2003 | Meshbesher | |
| 6,988,328 | B2 | 1/2006 | Rosen et al. | |
| 7,188,438 | B1 * | 3/2007 | Bowen | 36/7.1 R |
| 7,814,680 | B2 * | 10/2010 | Adami | 36/7.3 |
| 2003/0136026 | A1 | 7/2003 | Crary | |
| 2005/0066543 | A1 | 3/2005 | Rosen et al. | |

* cited by examiner

OVERSHOE

CROSS-REFERENCE TO RELATED APPLICATIONS

This application is a continuation-in-part application of U.S. application Ser. No. 11/050,099, filed Feb. 3, 2005, the entire disclosure of which is incorporated herein by reference.

TECHNICAL FIELD

This disclosure relates to footwear and more particularly to an overshoe that can be worn over another footwear structure.

BACKGROUND

A common problem for homeowners is the tracking of dirt and/or mud from outside a dwelling into the living area thereof by workers, children, spouses, and others. It is not unusual for a homeowner to require that a worker, children, spouse, and others remove their footwear to avoid contamination of the clean surfaces within the dwelling with dirt, mud, grass, debris, or contaminated fluid. This can be inconvenient when frequent entry and exit is required, or when rapid response, e.g., to ringing phones or household emergencies, is necessary. This inconvenience can result in missed calls, unresolved emergencies, or a lack of compliance with footwear removal requirements, leading to tracking up previously clean surfaces. Various footwear cleaning devices that remove dirt, mud, grass, and debris from the bottom of the footwear are well known. One known footwear cleaning device may be affixed to a door step or porch to enable persons entering a house to first clean off the dirt or mud from the footwear. This device may have a plurality of brushes which may be replaced from time to time.

Another known footwear cleaning device has removable bristles that can be mounted beneath a vehicle immediately adjacent one of the vehicle door openings. Another known cleaning device may include an anchoring means and a plurality of spaced rods that can be secured in an earthen surface and is sufficiently rigid to remove grass, dirt and debris from the bottom of footwear. Yet another known cleaning device may minimize transmission of communicable disease by removing debris and living microorganisms by brushing the sides and bottom of footwear in a container with sanitizing fluid.

As earlier indicated, the main concern of these conventional footwear cleaning devices is to prevent the dirt, mud, grass and debris adhering to the bottom of footwear from depositing on a clean area. Various options include cleaning footwear by brushing, scraping, washing with disinfectant solution, etc. All of the available cleaning methods, however, have involved obvious disadvantages. Accordingly, there remains a need for a new and improved device for keeping the dirt, mud, grass and other debris on footwear from contaminating a clean area.

BRIEF DESCRIPTION OF THE DRAWINGS

Features and advantages of embodiments of the disclosed subject matter will become apparent as the following Detailed Description proceeds, and upon reference to the Drawings, where like numerals depict like parts, and in which.

Figure 1:
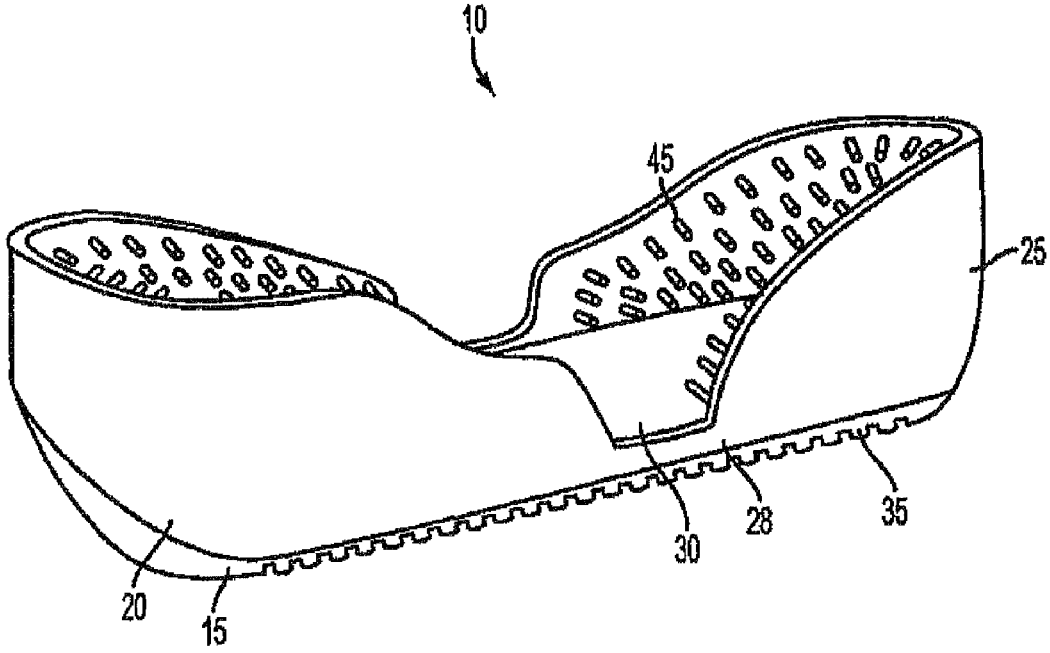
FIG. 1 is a perspective view of an overshoe consistent with an embodiment of the disclosure.
Figure 2:
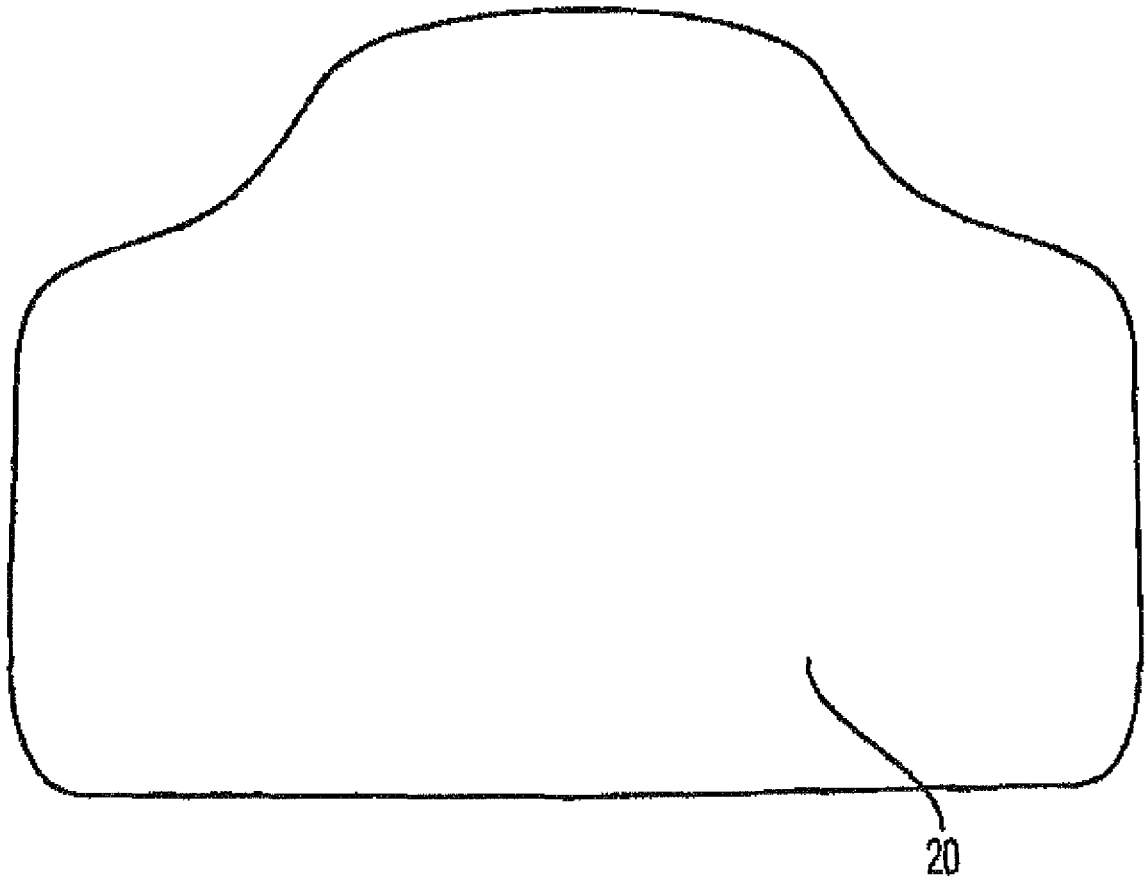
FIG. 2 is a front view of the overshoe of FIG. 1.
Figure 3:
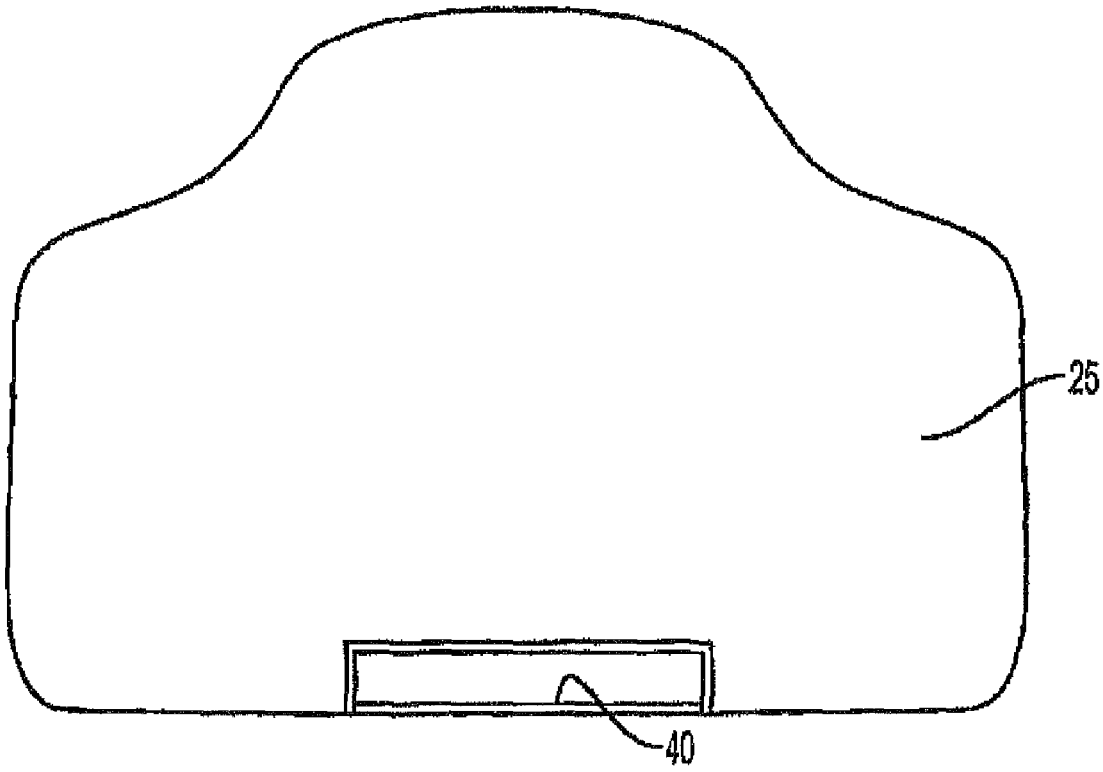
FIG. 3 is a rear view of the overshoe of FIG. 1.
Figure 4:
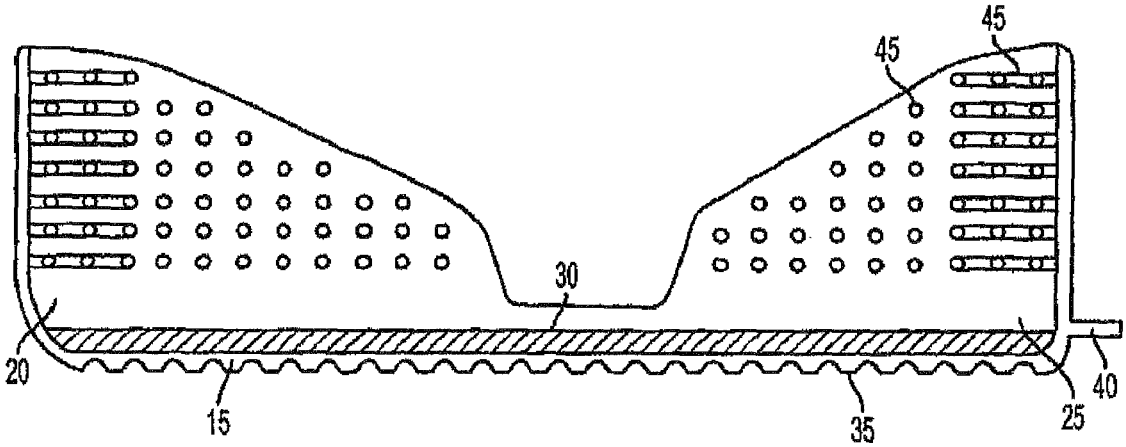
FIG. 4 is a cross-sectional view of the overshoe of FIG. 1.
Figure 5:
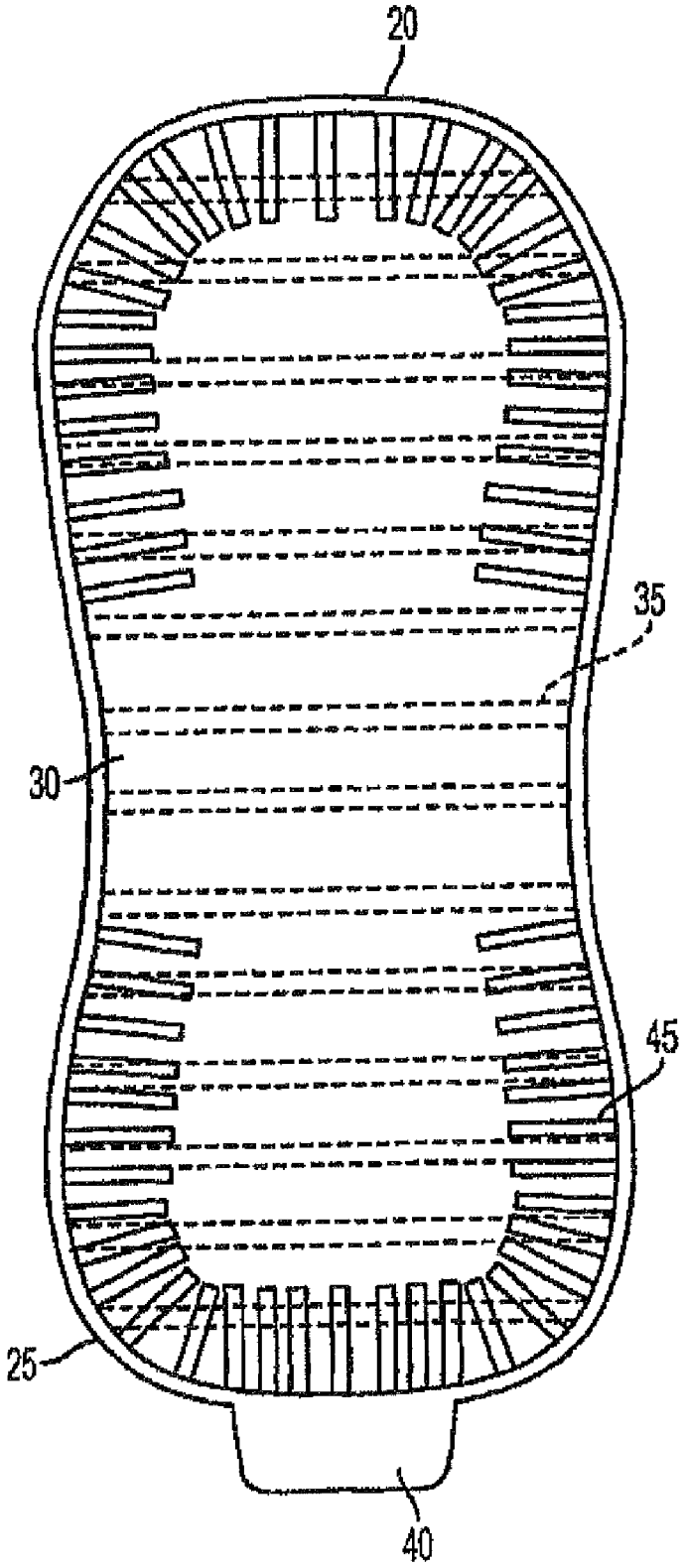
FIG. 5 is a top plan view of the overshoe of FIG. 1.
Figure 6:
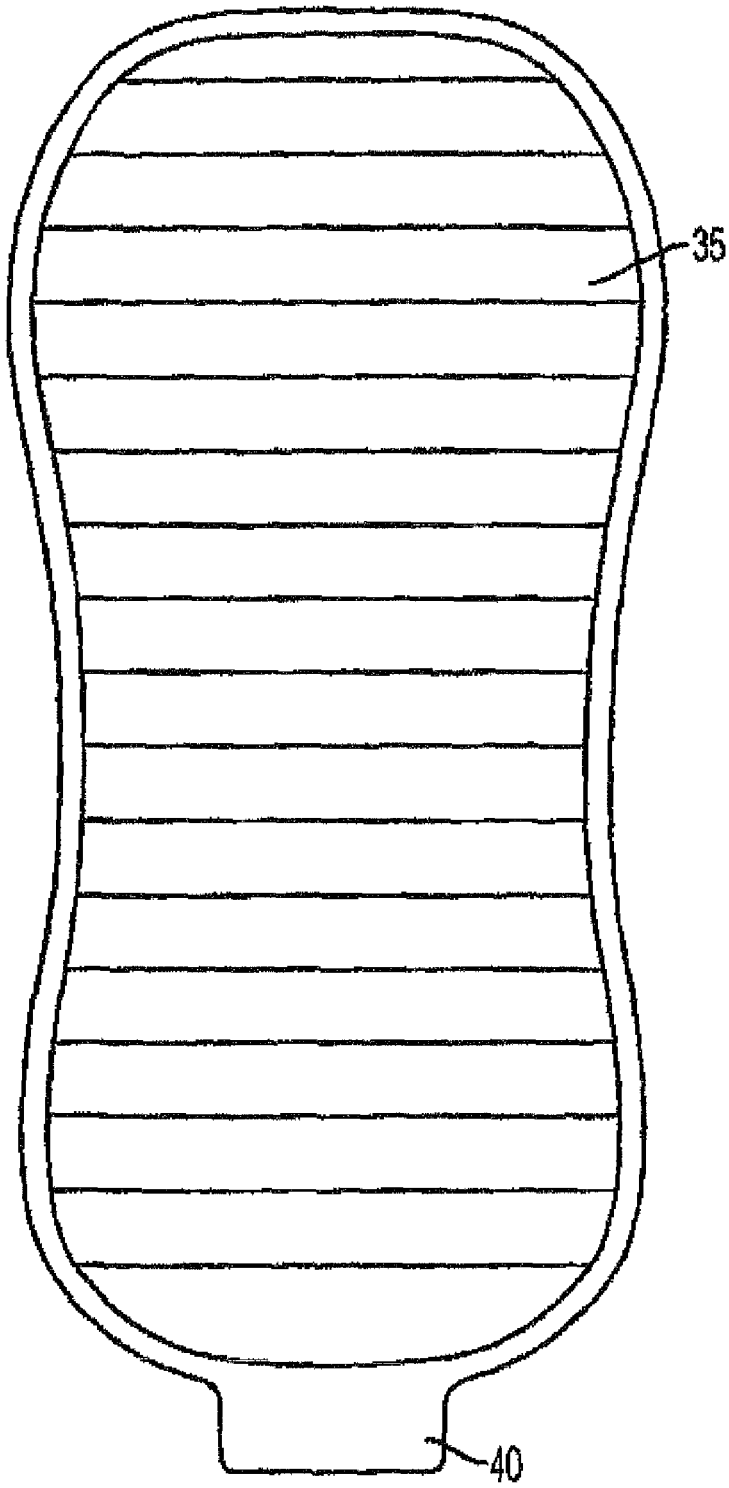
FIG. 6 is a bottom view of the overshoe of FIG. 1.
Figure 7:
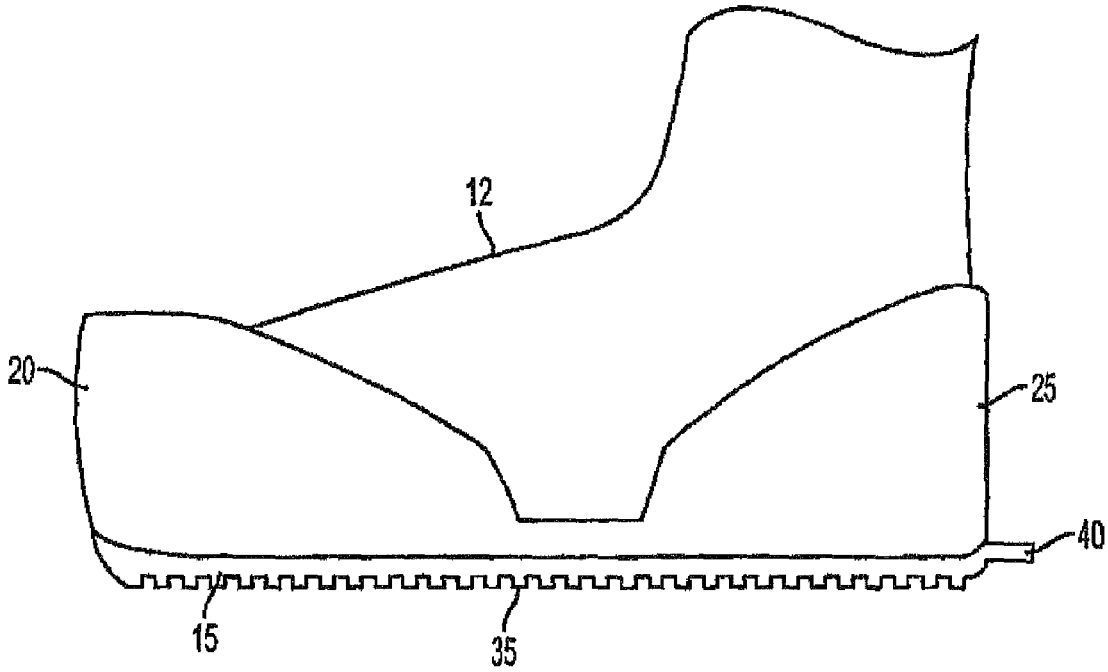
FIG. 7 is a side view of the overshoe of FIG. 1.

Although the following Detailed Description will proceed with reference being made to illustrative embodiments, many alternatives, modifications, and variations thereof will be apparent to those skilled in the alt. Accordingly, it is intended that the claimed subject matter be viewed broadly.

DETAILED DESCRIPTION

Referring to FIGS. 1-7, a first embodiment of an overshoe 10 consistent with the present disclosure is illustrated. The overshoe 10 of the first embodiment may have a base 15. The base 15 may have a front upright 20 and rear upright 25. The front and rear uprights 20, 25 are generally shown in FIGS. 1-7 as a unitary structure with a web 28 extending between the front and rear uprights 20, 25. Uprights 20 and 25 may be connected, e.g., via the web 28, to provide a single piece, for example by bonding, integral molding, or other methods. Alternatively, each upright 20 and 25 may be attached to base 15 directly, without connection to one another. The unitary front and rear upright assembly may be attached to the base 15 by similar methods as aforementioned, e.g., by integral molding, bonding, etc. The web 28 between the front and rear uprights 20 and 25 may be at least slightly higher than the base 15 to prevent and loose mud or contaminated fluid, not shown, from leaking out from the overshoe. The base 15 and uprights 20 and 25 may be made of plastic, rubber, or other materials which are well known to those skilled in the art.

A liner 30 may be attached to the upper portion of the base 15 for absorbing mud, dirt, grass, debris, and contaminated fluid. In other embodiments, the liner 30 may not be utilized. The liner 30 may be made of polyester or other fabrics that have strong absorption properties. The liner 30 may be attached to the base 15 by glue or other adhesive materials well known in the art. The bottom of the base 15 may have a pattern 35 to provide traction and prevent slippage. In addition, the base 15 may be molded with a tab 40 for easy removal from a footwear structure 12, shown in FIG. 7. While illustrated footwear structure 12 is shown in only shown in outline form, it is to be understood that an overshoe consistent with the present disclosure may be used with any type of athletic or non-athletic footwear structure, including, but not limited to walking shoes, sandals, running shoes, aerobic shoes, casual shoes, boots, specialty footwear, orthopedic or prescription footwear, etc.

One or more retention protrusions 45 may extend from the front and/or rear uprights 20, 25, e.g., extending from the inner surfaces thereof. As aforementioned, at least one of the front and rear uprights 20 and 25 may be at least partially higher than the footwear structure to be inserted therein. Therefore, the footwear structure may be at least partially covered and grasped by the overshoe 10 and its retaining protrusions 45. Protrusions 45 may be made of plastic, rubber, foam, or other resilient materials, preferably with relatively high durometer. Retaining protrusions 45 may be integrated into the front and/or rear uprights 20 and 25 by molding at one time, by gluing, or by other adhesive methods.

In use, the user may insert their footwear structure into the overshoe 10. The overshoe 10 can be readily lifted with the footwear structure by the user when the retaining protrusions 45 grasp the footwear structure. Wile the footwear structure is inside the overshoe, 10, the liner 30 may absorb any dirt, mud, grass, debris, or contaminated fluid from the footwear structure.

Figure 8:
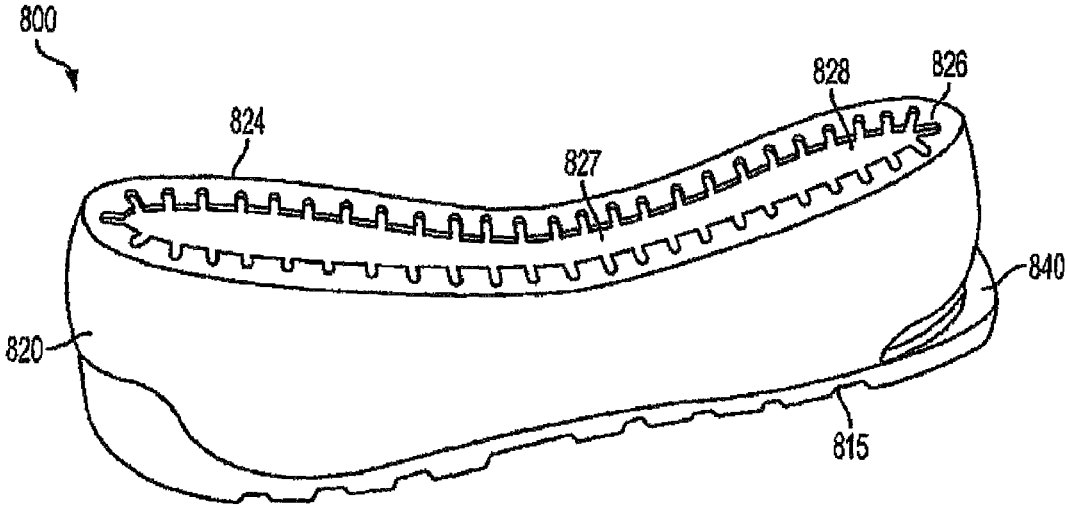
FIG. 8 is a perspective view of all overshoe consistent with another embodiment of the disclosure.

Turning to FIG. 8, a perspective view of an overshoe 800 consistent with a second embodiment of the disclosure is illustrated. The overshoe 800 may include a base 815 having an upstanding portion 820 extending generally about at least a portion of the base 815. In the illustrated embodiment, the upstanding portion 820 may generally extend around the entire perimeter of the base 820. The upstanding portion 820 may have a top edge 826 defining an opening 828 for a user to insert their footwear structure. A plurality of protrusions, e.g., in the form of teeth 824, may extend inwardly from the upstanding portion 820. The teeth 824 may be made of molded plastic, rubber, or other resilient materials and may extend inwardly from the top edge 826 of the upstanding portion 820. For example, the teeth may generally extend inwardly from all inner surface 827 of the upstanding portion 820. Although the teeth 824 are illustrated extending inwardly from the entire perimeter of the top edge 826 of the upstanding portion 820, some perimeter portions of the top edge 826 may have no teeth. The inwardly extending teeth 824 may also be located below the top edge 826 of the upstanding portion 820. The amount and location of the teeth 826 may be selected to be sufficient to securely affix the overshoe 800 to a footwear structure of a user when the user inserts the same into the opening 828 without the use of any other additional protrusions, e.g., in the form of brushes or bristles on the inner surface 827 of the upstanding portion 820. The base 815 may also have a tab 840 extending therefore to assist with removal of a footwear structure from the overshoe 800.

Figure 9:
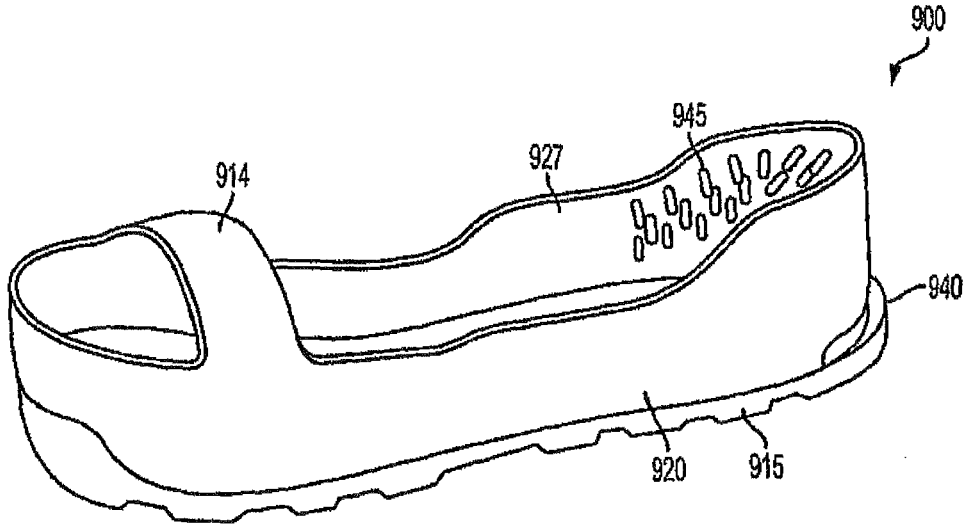
FIG. 9 is a perspective view of an overshoe consistent with yet another embodiment of the disclosure.

Turning to FIG. 9, a perspective view of an overshoe 900 consistent with another embodiment of the disclosure is illustrated. The overshoe 900 may include a base 915 having an upstanding portion 920 extending generally about at least a portion of the base 915. The upstanding portion 920 may have a forefoot strap 914 to hold the front of the footwear structure in the overshoe 900. The forefoot strap 914 may be integrally molded with the upstanding portion 920 or may be a separate strap coupled to the upstanding portion 920. The strap may also be an adjustable strap to adjust the size of the strap to accommodate footwear structures of differing shapes and sizes. In other embodiments, the upstanding portion may not extend around the entirety of the front portion of the base. In such an embodiment, to forefoot strap may extend from generally opposed sides of the base to hold the front of a footwear structure.

A heel area of the upstanding portion 920 may also have protrusions 945, extending inwardly from an inner surface 927 of the upstanding portion 920, to provide a heel locking system for a user of the overshoe 900. As used in any embodiment herein, protrusions may be configured as "fingers", brushes, spikes, bristles, teeth, a foam block, or other mechanisms extending inwardly from at least one upstanding portion of the overshoe, e.g. from an inner surface of the upstanding portion. The geometry, size, and length of the protrusions may vary according to various applications and embodiments. According to one embodiment, the protrusions may extend inwardly from an inner surface of an upstanding portion at least ¼ inch, however longer and shorter protrusions, and combinations of longer and shorter protrusions, may also suitably be used. Also, a single protrusion extending inwardly around the perimeter of at least one upstanding portion, or around a portion thereof, may be provided.

In one embodiment, the protrusions 945 may extend perpendicularly from the upstanding portion 920. In operation, a user may insert their footwear structure into the overshoe 900. The forefoot strap 914 may secure the front of the footwear structure and the protrusions 945 may secure the heel of the footwear structure. The user may readily insert their footwear structure into the overshoe 900 and remove their footwear structure from the overshoe 900 without the use of their hands, thereby leaving their hands free for other tasks. The overshoe 900 may also include a tab 940 extending from the base 915 to assist with the removal of a footwear structure from the overshoe 900.

Figure 10:
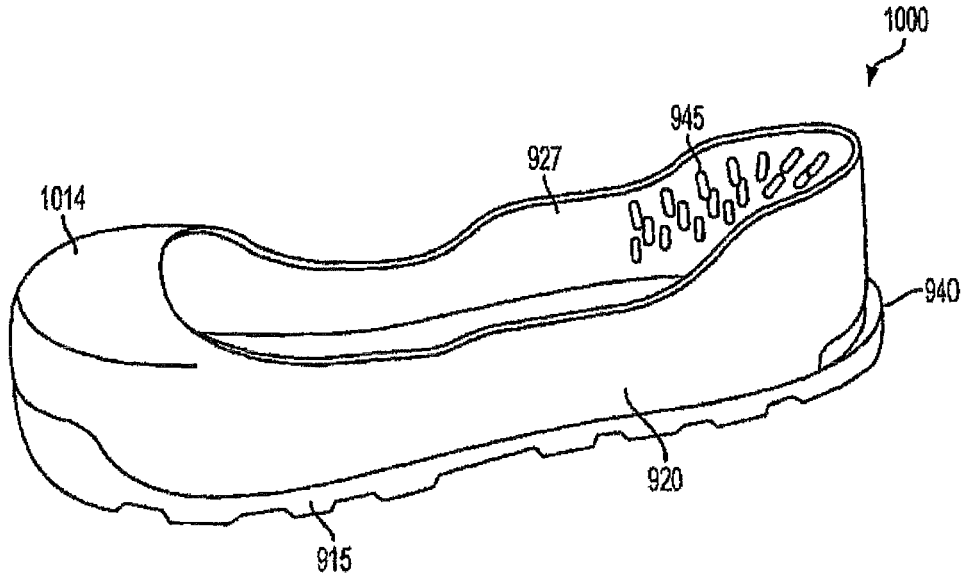
FIG. 10 is a perspective view of an overshoe consistent with yet another embodiment of the disclosure.

Turning to FIG. 10, a perspective view of an overshoe 1000 consistent with a related embodiment of the disclosure is illustrated. The illustrated embodiment of the overshoe 1000 is similar to previous embodiment of the overshoe 900 of FIG. 9 except that the forefoot strap 914 of FIG. 9 may be replaced with a forefoot bumper 1014 to secure the front of the footwear structure to the overshoe 1000. As shown, the forefoot bumper 1014 may at least partially overlie a toe portion of a footwear structure to secure the overshoe 1000 thereto. The heel of the footwear structure may be secured by the protrusions 945. Similar to the second embodiment, the user may readily insert their footwear structure into the overshoe 1000 and remove their footwear structure from the overshoe 1000 without the use of their hands to leave their hands free for other tasks.

The forefoot bumper 1014 is shown as a continuous feature of the upstanding portion 920. In other embodiments, the upstanding portion 920, which may define the heel portion of the overshoe 1000, may not extend to the forward portion of the base 915. The forefoot bumper 1014 may extend directly from the base 915 separate from the upstanding portion 920. Additionally, the forefoot bumper may define a toe-well as part of a second upstanding portion, which may be separate from the upstanding portion defining the heel portion of the overshoe.

Figure 11A:
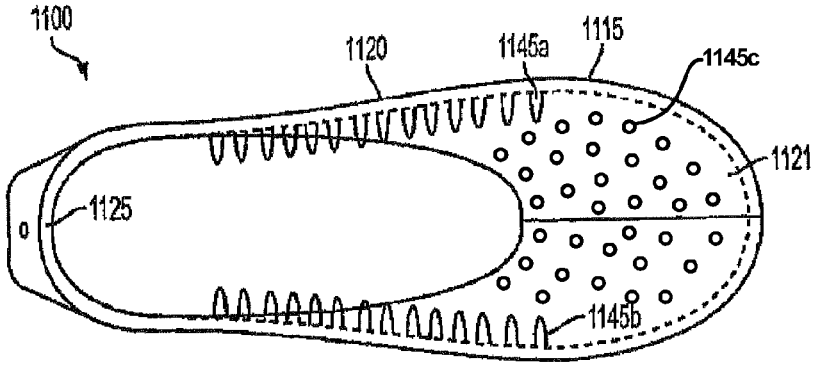
FIG. 11A is a top plan view of yet another embodiment of an overshoe consistent with the disclosure.
Figure 11B:
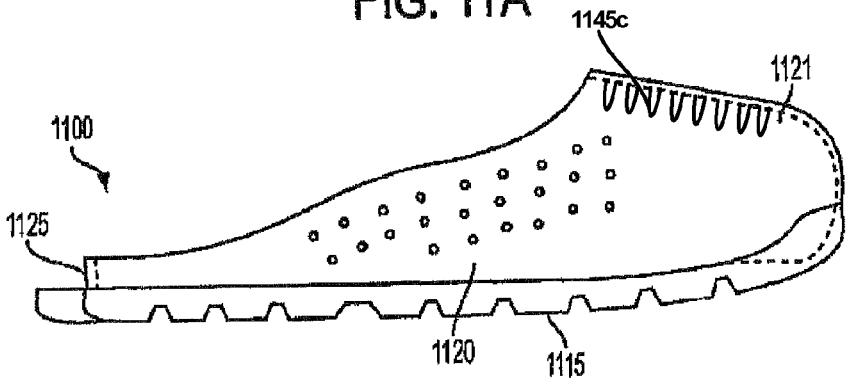
FIG. 11B is a side view of the embodiment of FIG. 11A.
Figure 11C:
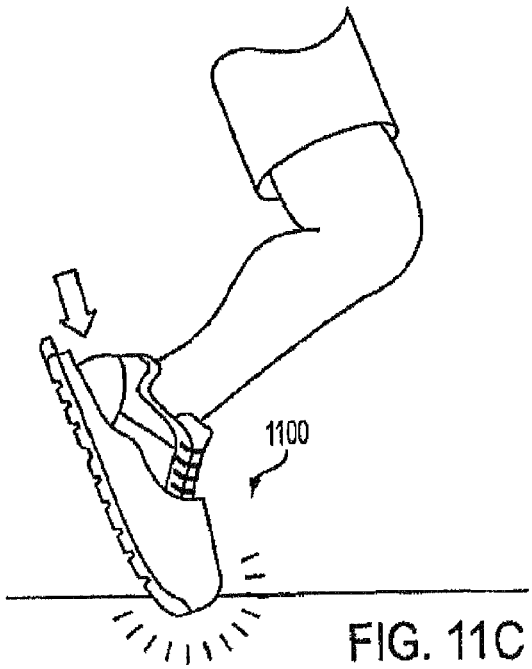
FIG. 11C is a perspective view of the embodiment of FIG. 11A.

Turning to FIGS. 11A-11C, various views of an overshoe 1100 consistent with yet another embodiment of the disclosure is illustrated. The overshoe 1100 may be configured for sliding rear-entry of a footwear structure. The overshoe 1100 may include a base 1115 and an upstanding portion 1120, at least in part, defining a toe well 1121 configured to receive at least a portion of a footwear structure toe. As shown in the plan view and side view of FIGS. 11A and 11B, an inner portion of the upstanding portion 1120 in the region of the toe well 1121 may include extending protrusions 1145*a*, 1145*b* generally extending inwardly from an inner surface of the upstanding portion 1120. The protrusions 1145*a*, 1145*b* may be disposed on the lateral and medial sides of the upstanding portion 1120, and may also extend from the upstanding portion 1120 in the region of the toe well 1121. The protrusions 1145*a*, 1145*b* may secure the overshoe 1100 to the toe of a footwear structure inserted into the toe well 1121. Protrusions 1145*c* may also extend downwardly from the toe well 1121.

The user may insert the toe of a footwear structure into the toe well 1120 of the overshoe 1100, and the lateral and medial protrusions 1145*a*, 1145*b* may secure the overshoe 1100 to the front and sides of the footwear structure. As shown in FIG. 11C, the user may kick the overshoe 1100 against the ground, or other suitable surface, to drive the toe of the footwear structure farther into toe well 1120. Kicking the footwear structure into the overshoe 1100 may seat the footwear structure securely in the toe well 1120.

The upstanding portion 1120 may extend from the toe well 1121 toward the rear of the base 1115 to at least partially surround a portion of the side of a footwear structure inserted into the toe well 1121. The upstanding portion 1120 may taper as it extends toward the rear of the base 1115 to provide a shallow rear upstanding portion 1125. The rear upstanding portion 1125 may help contain any dirt or liquid, etc., that may be on the footwear structure. The reduced height of the rear upstanding portion 1125 may allow dirt or liquid, etc., from the footwear structure to be contained while still permitting generally sliding insertion of the toe of the footwear structure into the toe well 1121 of the overshoe 1100.

Figure 12A:
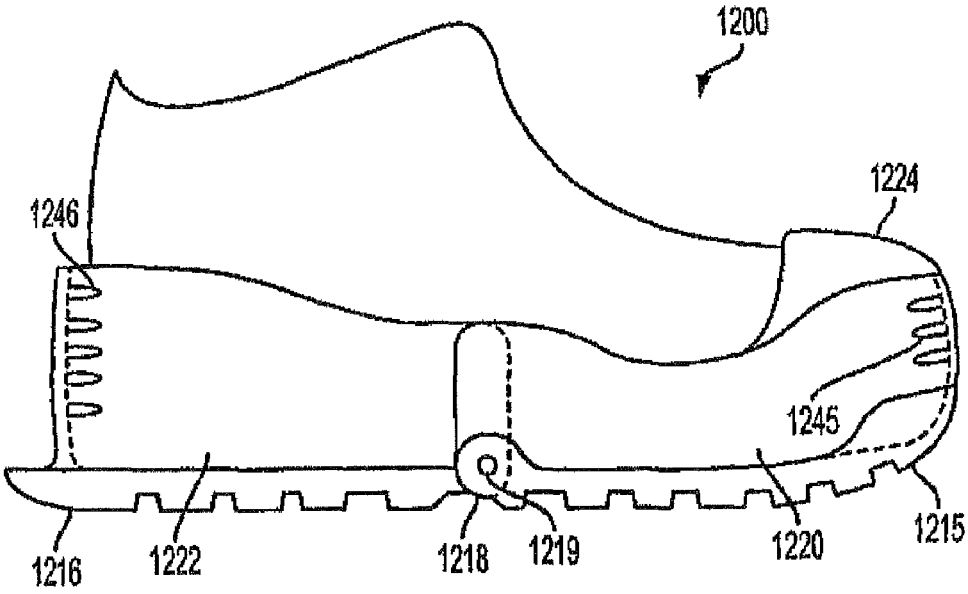
FIG. 12A is a side view of yet another embodiment of an overshoe consistent with the disclosure having a hinge in a locked position.
Figure 12B:
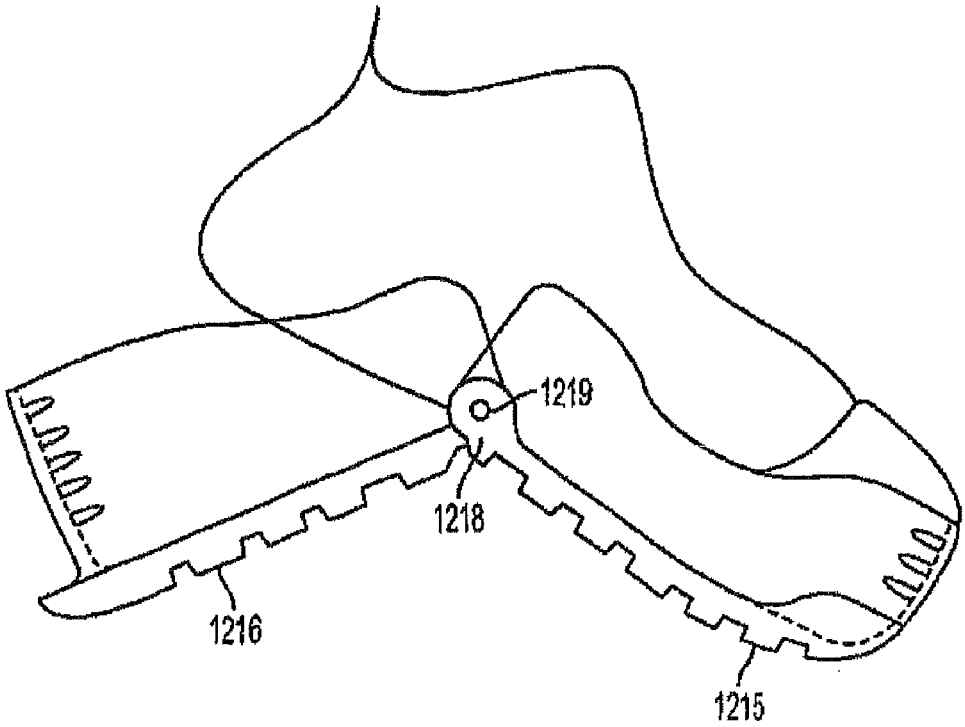
FIG. 12B is a side view of the embodiment of FIG. 12A having the hinge in an unlocked position.

Referring to FIGS. 12A and 12B, an embodiment of an overshoe 1200 which may use a hinging action for securing to a footwear structure is shown. The overshoe 1200 may include a forward and rear base portion 1215, 1216. The forward and rear base portions 1215, 1216 may be hingedly coupled together to allow the base portions 1215, 1216 to bend relative to one another. Hinging coupling of the base portions 1215, 1216 may be accomplished with a mechanical hinge feature 1218, which may include one or more pivots 1219. Other arrangements, such as a living hinge, may also be used to hingedly couple the base portions 1215, 1216 together.

The overshoe 1200 may include more than one upstanding portion. For example, the forward base portion 1215 may include a forward upstanding portion 1220, and the rear base portion 1216 may include a corresponding rear upstanding portion 1222. In one embodiment, the forward and rear upstanding portions 1220, 1222 may generally extend around the perimeter of the respective base portions 1215, 1216, and may provide the overshoe 1200 with a generally continuous upstanding portion. In other embodiments, however, there may be a gap between the upstanding portions 1220,1222. The forward base portion 1215 may include an over-the-top toe bumper 1224, toe strap, etc., for securing the toe of a footwear structure. The forward upstanding portion 1220 may also include protrusions 1245 in combination with the toe bumper 1224 to assist securing the toe of a footwear structure. Other embodiments of the overshoe 1200 may only include a single securement feature, such as the toe bumper 1224 or protrusions 1245 for securing a footwear structure. Similarly, the rear upstanding portion 1222 may protrusions 1246, such as the illustrated bristles, teeth, resilient block, etc., for securing a heel portion of a footwear structure.

The overshoe 1200 may be bent about the hinge to angle the base portions 1215, 1216 relative to one another to "open" the overshoe 1200. A user may insert a toe-portion of a footwear structure into the forward base portion 1215 and step down with the heel of the footwear structure. Stepping down with the heel in this manner may bend the hinge to a flat position, closing the overshoe 1200 on the footwear structure. The toe of the footwear structure may be secured by the forward securement features, e.g., the protrusions, forefoot bumper, etc., either before or after stepping into the overshoe to close it around the footwear structure. The rear protrusions 1246 may further lock the overshoe 1200 to the footwear structure. To this end, the rear protrusions 1246 may extend around a side portion of the rear upstanding portion 1222 to better grip the rear portion of the footwear structure. Additionally, the overshoe 1200 may include features, such as detents, etc., to maintain the hinge in the locked or closed position. Maintaining the hinge in a locked or closed position may assist in retaining the overshoe 1200 to a footwear structure.

Figure 13A:
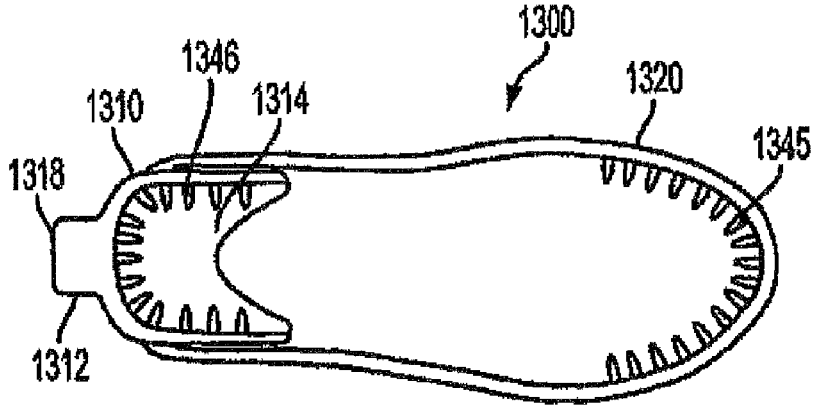
FIG. 13A is a top plan view of yet another embodiment of an overshoe consistent with the disclosure.
Figure 13B:
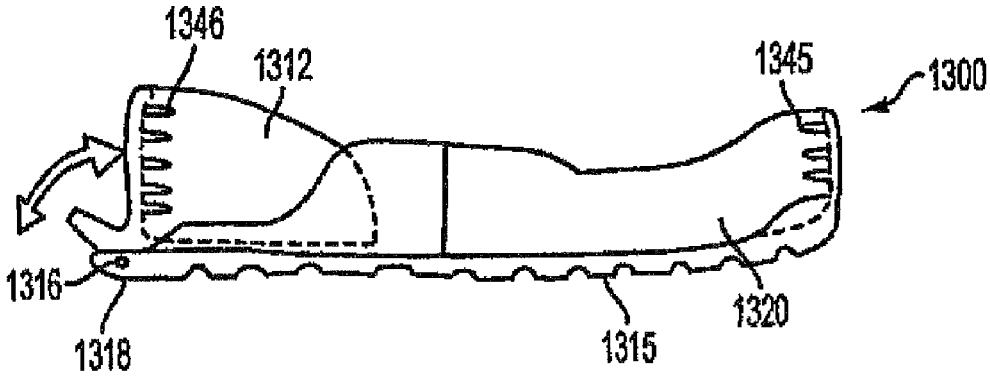
FIG. 13B is a side view of the embodiment of FIG. 13A with a hinge in a locked position.
Figure 13C:
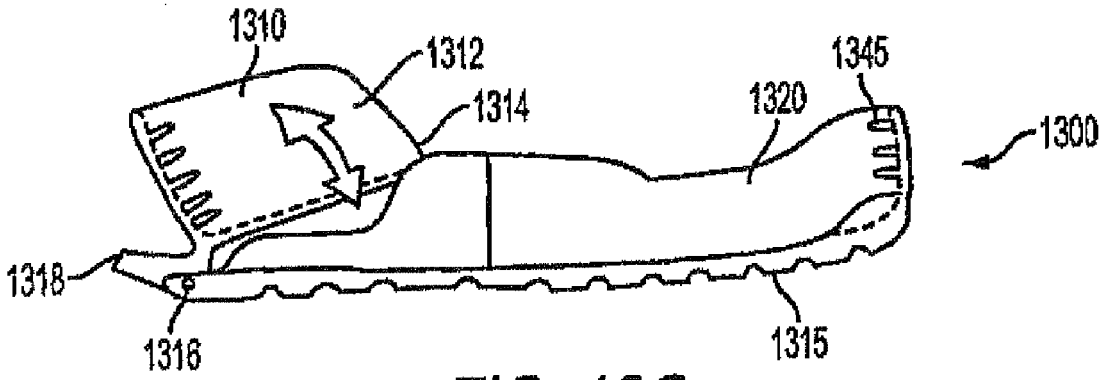
FIG. 13C is a side view of the embodiment of FIG. 13A with the hinge in the unlocked position.

FIGS. 13A through 13C depict a related embodiment of all overshoe 1300. The overshoe 1300 may generally include a base 1315 and an upstanding portion 1320 generally extending around at least a portion of the base 4315. A forward portion of the overshoe 1300 may include securement features, such as protrusions 1345, a toe strap, forefoot bumper, etc. for gripping or securing to a forward portion of a footwear structure.

The overshoe 1300 may also include a heel portion 1310 having an upstanding portion 1312 and a bottom portion 1314. The heel portion 1310 may be pivotally disposed relative to the overshoe base 1315. For example, as shown a rearward region of the heel portion 1310 and of the overshoe base 1315 may include cooperating hinge features and a hinge pin 1316. The hinge features and hinge pin 1316 may pivotally coupled the heel potion 1310 and the base 1315 to allow the heel portion 1310 to pivot between a locked position, as shown in FIG. 13B, mid all unlocked, or opened, position such as shown in FIG. 13C. The heel portion 1310 may further include a tab 1318 to assist moving the heel portion 1310 between the locked and unlocked positions.

The heel portion 1310 of the overshoe 1300 may be pivoted to the unlocked position to allow easier insertion of a user's footwear structure into the overshoe 1300. Unlocking the hinge and pivoting the heel portion 1310 rearwardly may be accomplished by pressing down on the tab 1318, with a hand, the toe of a footwear structure, etc. With the heel portion 1310 in the unlocked position a user may step into the overshoe 1300, urging the toe of the footwear structure into the securement features, such as the protrusions 1345, at the front of the overshoe 1300. The heel portion 1310 may be moved to the locked, or closed, position by stepping down on the bottom portion 1314, causing the heel portion 1310 to pivot forward.

Securement features in the heel portion 1310, such as protrusions 1346, may assist in providing secure retention of the overshoe 1300 to the user's footwear structure. The user's weight on the bottom portion 1314 of the heel portion 1310 may maintain the heel portion 1310 in the locked or closed position. Additionally, the heel portion 1310 and the base 1315 or upstanding portion 1320 of the overshoe may include interacting features, such as detents or the like, which may also assist in releasably maintaining the heel portion 1310 in the locked position.

In a related embodiment, an overshoe may include a front cover overlying at least a portion of the toes, such as a forefoot bumper, toe cover, etc. The front cover may be pivotally coupled to the base of the overshoe, allowing the front cover to pivot forward or to the side of the overshoe to an open position. With the front cover in the open position, a user may step into the overshoe and then pivot the front cover to a closed position, in which the front cover may overlie at least a portion of the toe or instep of the user's footwear structure. The front cover may include one or more detents, straps, etc., for releasable maintaining the front cover in the closed position.

According to one embodiment, similar to the heel portion shown in FIGS. 13A-13C, the front cover may include a bottom portion. When the user steps into the overshoe, and down on the bottom portion of the front cover, the front cover may be pivoted to the closed position. The front cover may further be maintained in the closed position, at least in part, by the pressure of the users footwear structure pressing down on the bottom portion of the front cover.

Figure 14:
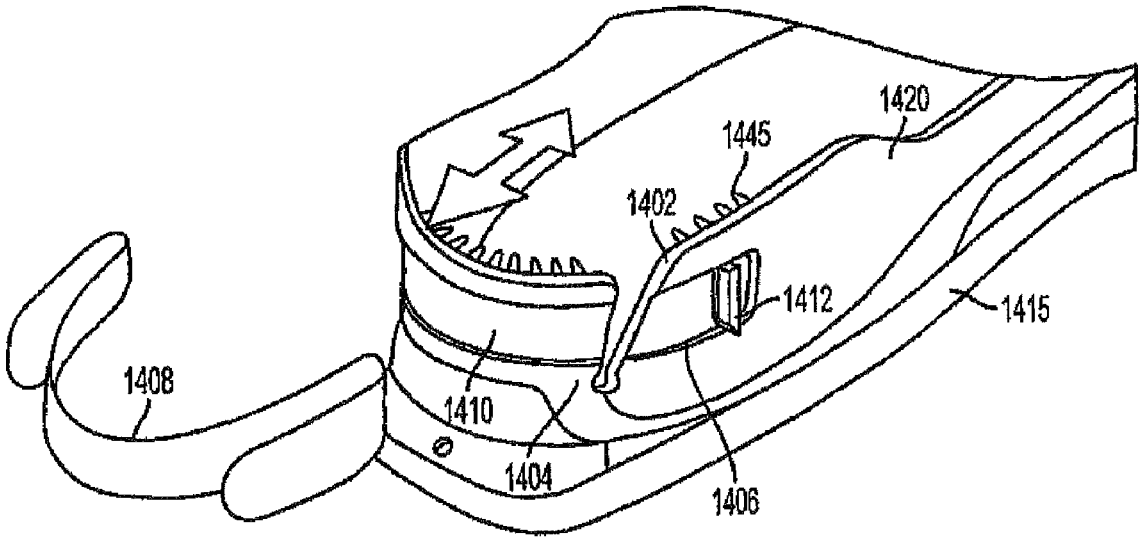
FIG. 14 is a perspective view of another embodiment of an overshoe consistent with the disclosure.

A partial view of yet another embodiment of an overshoe 1400 is shown in FIG. 14. The overshoe 1400 may be adjustable for use with a variety of footwear structure sizes. As shown, similar to preceding embodiments, the overshoe 1400 may include a base 1415 and an upstanding portion 1420 generally extending around at least a portion of the base 1415. The overshoe 1400 may further include securement features, such as protrusions 1445 extending inwardly from an inner surface of the upstanding portion 1420, toe straps, forefoot bumper, etc., for securing the overshoe 1400 to a user's footwear structure.

The upstanding portion 1420 may include at least one notch 1402 extending at least a portion of the height of the upstanding portion 1420. The upstanding portion 1420 may include a corresponding notch on the other side of the overshoe 1400. Other embodiments may include an even greater number of notches. The notch 1402 may be formed as a V-shaped cutout, as shown. In other embodiments, the notch 1402 may be provided having a variety of shapes, such as rectangular, rounded, etc. Additionally, the notch 1402 may extend the entire height of the upstanding portion, e.g., down to the base, or only a portion of the height of the upstanding portion 1420.

The fit of the overshoe 1400 may be adjusted by deforming regions 1404, 1406 of the upstanding portion 1420 on either side of the notch 1402 toward each other. An adjustment features, such as the adjustable strap 1408, may be provided to extend across the notch 1402 and may be tensioned to draw the regions 1404, 1406 of the upstanding portion 1420 together. In the illustrated embodiment, the adjustable strap 1408 may be a removable strap having cooperating regions of hook and loop fasteners. The strap 1408 may be at least partially received in a groove or channel 1410 in the upstanding portion 1420. The strap may be looped through a D-ring 1412, cutout, etc., to allow the adjustable strap 1408 to be tensioned across the notch 1402 by adjusting the hook and loop fasteners. Tensioning the strap 1408 across the cutout 1402 may draw the regions 1404, 1406 of the upstanding portion 1420 together, which may at least partially close the notch 1402.

Tensioning the adjustment strap 1408 to draw together the regions 1404, 1406 of the upstanding portion 1420 on either side of the notch 1402, i.e., closing the notch, may correspondingly reduce the length or perimeter of the opening defined by the upstanding portion 1420 of the overshoe 1400. The reduction in the length or perimeter of the opening may allow the securement features 1445 to engage a smaller footwear structure as compared to when the regions 1404, 1406 of the upstanding portion 1420 on either side of the notch 1402 are not drawn together. The adjustment strap 1408 may, in this manner, allow the overshoe 1400 to be adjusted to be suitably securable to footwear structures of various sizes.

In addition to the illustrated adjustable strap, many different arrangements may be employed for opening and closing the notch to adjust the fit of the overshoe. For example, the upstanding portion of the overshoe may include a snap coupled to one side of the notch and adjustably securable to the other side of the notch. The overshoe may also include laces, or similar features, extending across the notch for adjusting the closure of the notch. Various additional arrangements for adjusting the size of the overshoe will also be apparent to those having skill in the art.

Figure 15A:
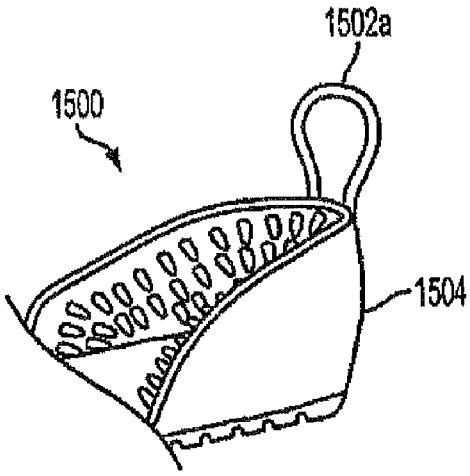
FIG. 15A is a partial perspective view of an embodiment of an overshoe having a pull tab.
Figure 15B:
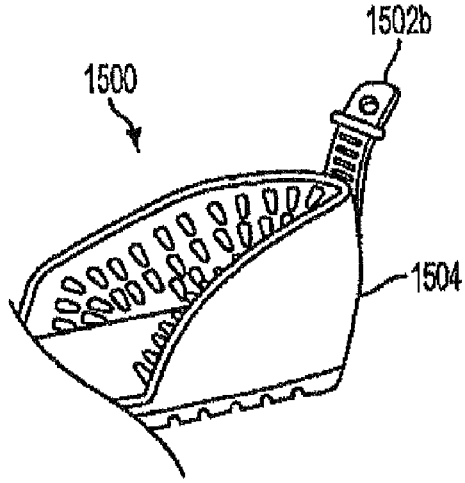
FIG. 15B is partial view of another embodiment of an overshoe having a pull tab.
Figure 15C:
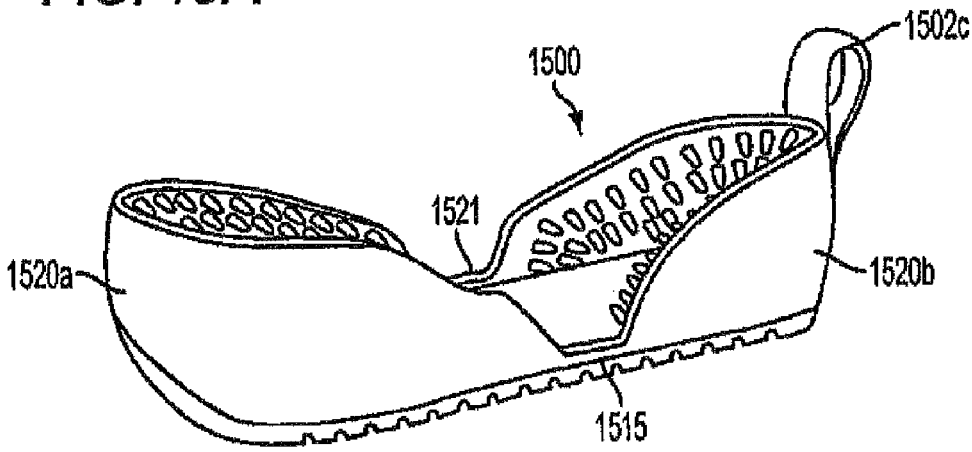
FIG. 15C is a perspective view of another embodiment of an overshoe having a pull tab.
Figure 15D:
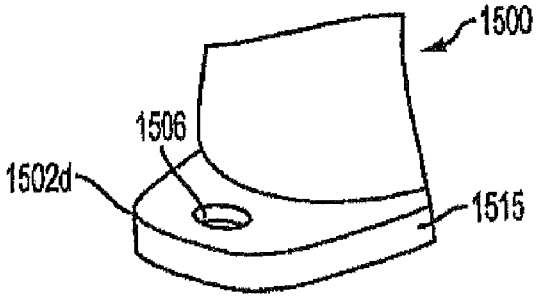
FIG. 15D is a partial perspective view of an embodiment of an overshoe having a heel tab.

Referring to FIGS. 15A through 15C, according to one aspect an overshoe 1500 may include a pull tab 1502, which may facilitate donning and doffing of the overshoe 1500 by providing a feature which may be grabbed for applying a force, e.g., puling, the heel of the overshoe. Of course, pull tabs consistent with this aspect of the disclosure may be associated with portions of the overshoe other than the heel, e.g., a pull tab may be associated with a front portion of the overshoe, etc. As shown in FIG. 15A, according to one embodiment, the pull tab 1502*a* may be a looped cord, for example rope, plastic strand, etc., The looped cord pull tab 1502*a* may be sewn, adhesively bonded, etc. to the heel portion 1504 of the overshoe 1500.

Turning to FIG. 15B, according to another embodiment a pull tab 1502*b* may be provided as a strip of material extending from the heel portion 1504 of the overshoe 1500. The strip of material may be a plastic, fabric, or other suitable material. The strip pull tab 1502*b* may be integrally molded with the heal portion 1504 of the overshoe. Alternatively, the strip pull tab 1502*b* may be sewn, adhesively bonded, welded, etc. to the overshoe 1500.

As a further variation on the foregoing, the overshoe 1500 may include a pull tab 1502*c* which may be provided by a strip of material formed into a loop. For example, the pull tab 1502*c* may be a length of webbing folded upon itself to provide a loop. Various materials other than webbing may also suitably be employed, such as a plastic strip, etc. As with preceding embodiments, the pull tab 1502 may be sewn, adhesively bonded, or otherwise joined to the heel portion of the overshoe 1500.

As shown in FIG. 15C, the overshoe 1500 may include an upstanding portion 1520 adjacent to a front region of the base 1515 and may also include an upstanding portion adjacent a rear region of the base 1515. As shown, the upstanding portions 1520*a*, 1520*b* may be generally separate portions. However, the upstanding portions may also be connected, for example, by a web 1521, e.g., in the form of a shorter upstanding portion. The web 1521 and the upstanding portions 1520*a*, 1520*b* adjacent the front and rear regions of the base 1515 may be provided as a single integral feature. As an extension of this, the web 1521 may have a height that is generally the same as the upstanding portions 1520*a*, 1520*b* adjacent the front and rear regions of the base 1515, thereby providing a single generally continuous upstanding portion, as shown in connection with previous embodiments, such as those of FIGS. 8 through 10, etc.

In addition to providing a feature which may be grabbed to apply a force during donning or doffing, a pull tab 1502 consistent with the present disclosure may also be configured facilitate storage of the overshoe 1500. For example, the pull tab 1502 may form a loop or be provided with an opening that may allow the overshoe be hung up by the pull tab 1502, e.g., on a hook or nail. Similarly, the loop or opening in the pull tab 1502, and even the pull tab 1502 itself, by also facilitate carrying of the overshoes 1500. In a related embodiment, the overshoe 1500 may include a tab 1502*d* extending from, or formed as an extension of, the base 1515 of the overshoe 1500. The tab 1502*d* may include an opening 1504 that may, similarly, be used for storage or carrying of the overshoes 1500.

Figure 16A:
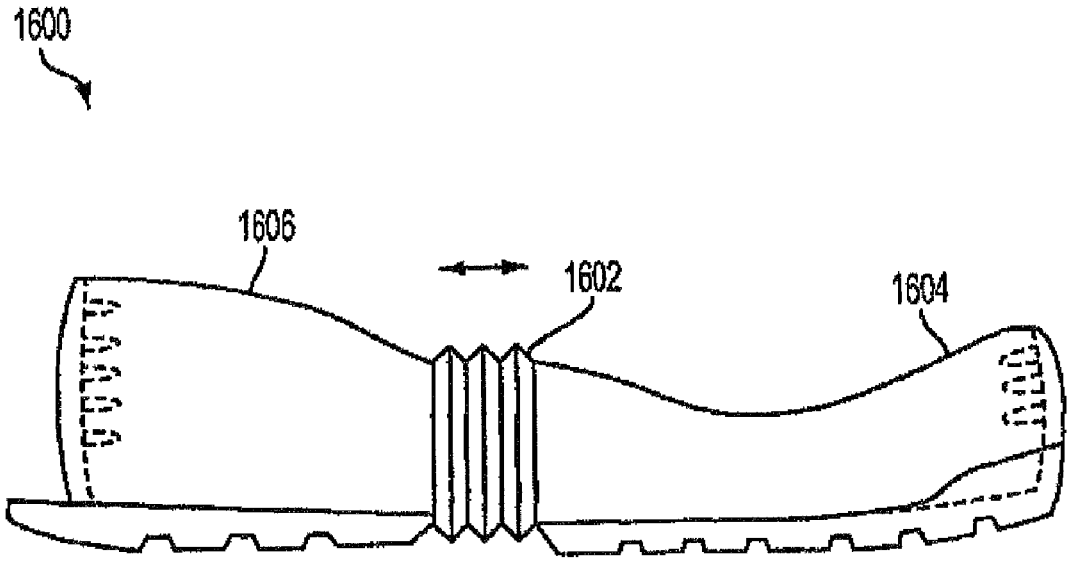
FIG. 16A is a side view of n embodiment of an overshoe including an expansion feature consistent with an embodiment of the present disclosure.
Figure 16B:
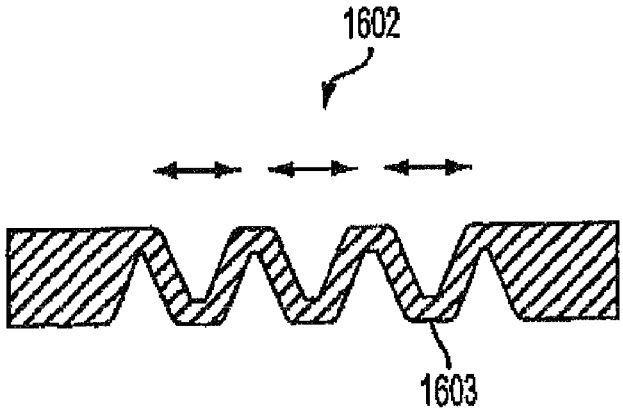
FIG. 16B is a detailed view of the expansion feature of the overshoe shown in FIG. 16A.

Turning to FIGS. 16A and 16B, an overshoe 1600 may include an expansion feature, such as an expansion zone 1602, that may allow the overshoe 1600 to resiliently expand and contract. For example, the expansion zone 1602 may be disposed between a front 1604 and rear 1606 portion of the overshoe 1600. The expansion zone 1602 may, therefore, permit lengthwise expansion or stretching of the overshoe 1600, as in the depicted embodiment. The lengthwise stretching or expansion of the overshoe 1600 may accommodate different sized footwear structures, or may be included as an aspect of the securement feature of the overshoe 1600. Similar expansion features may be arranged to provide transverse expansion, i.e., expansion of the width of the overshoe.

As shown in detail in FIG. 16B, the expansion zone 1602 may include a serpentine or bellows wall 1603 configuration. Expansion, or stretching, of the expansion zone 1602 may at least partially "straighten out" the serpentine wall 1603 to increase the length of the expansion zone 1602. The material characteristics, for example, the modulus, elasticity, etc., may bias the expansion zone 1603 toward the serpentine or bellows configuration. Various other configurations may similarly provide expansion zones consistent with this aspect of the disclosure. Furthermore, the overshoe 1600 may include a plurality of expansion zones to provide even greater possible expansion.

In other embodiments, the expansion feature may be provided as a stretch zone formed from materials that stretch, such as rubber and various plastics. In such embodiments the expansion, or stretching, of the overshoe may be a function of the elastic characteristics of the material. In further embodiments, mechanical expansion zones 1602 and elastic or stretchable materials may be used together to provide an expansion feature.

Expansion features, such as the expansion zone 1602, may be integrally formed into the overshoe 1600, or may be formed as a separate feature which may be coupled to the front 1604 and rear 1606 portions of the overshoe 1600. Separately formed expansion features may be welded, bonded, etc., to the respective regions of the overshoe 1600 to provide the expandable overshoe. The expandable overshoe 1600 may accommodate different sized footwear structures, allowing one size of overshoe 1600 to be used with a variety of footwear structure sizes. Additionally, the resiliently expandable aspect provided by the expansion features may assist securing the overshoe 1600 to a footwear structure. The overshoe 1600 may be expanded, for example by manually stretching the overshoe 1600, and positioned on the footwear structure. The expansion feature may then resiliently recover, providing secure engagement between the overshoe 1600 and the user's footwear structure. In this manner, the expansion feature may work in conjunction with, or as an alternative to, other securement features, such as resilient protrusions, etc., of the overshoe.

Figure 17:
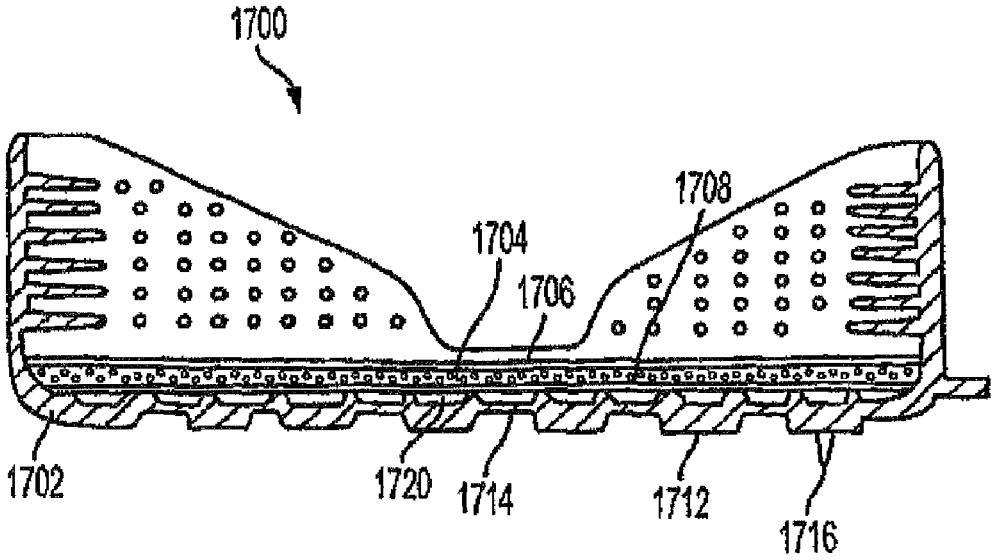
FIG. 17 is a cross-sectional view of an embodiment of an insulating overshoe according to one aspect of the disclosure.

With reference to FIG. 17, an overshoe 1700 may be configured to provide thermal insulation between a user and ground or walking surface. Such embodiments might be useful for use on hot surfaces, such as while installing asphalt, during hot weather, etc., as well as on cold surfaces, such as when working on cold surfaces such as in a cold storage facility, during cold weather, etc. Additionally, an overshoe may, in some embodiments, be provided having an enlarged footprint for greater weight distributions, giving a snowshoe effect. Such a feature may be beneficial when working on snow, or surfaces, such as fresh concrete, fresh asphalt, etc., which may be damaged by concentrated loads.

An insulating overshoe 1700 may include a sole 1702 and an insulating layer 1704 disposed above the sole 1702. The insulating layer 1704 may be a foam, or other insulating material, and may include a top and bottom layer 1706, 1708. The top and bottom layers 1706, 1708 of the insulating layer 1704 may, in some embodiments, act as barrier layers on the insulating layer 1704. Spaces 1710 may be provided between at least a portion of the sole 1702 and the insulating layer 1704. The spaces may provide additional insulation, and may also decrease contact between the insulating layer 1704 and the sole 1702, which may reduce thermal conduction between the sole 1702 and the insulating layer 1704. Similarly, the sole 1702 may be provide with lugs 1712, ribs, etc., which may provide spaces 1714 between adjacent lugs 1712 for air circulation between at least a portion of the sole 1702 and the walking or contact surface. As an additional features, an overshoe may include one or more spikes 1716, cleats, or similar feature to enhance traction, e.g., on ice or other low traction surface. Additionally, the material of the sole may be selected to provide enhanced traction on slippery surfaces such as ice.

In addition to the various structural features, an insulating overshoe 1700 may be constructed of materials selected to provide protection against the temperature conditions. For example, an overshoe intended for use on hot surface may be formed from a high temperature material which won't melt or otherwise deteriorate at the desired use temperatures. For low temperature applications, the overshoe may include materials which may remain flexible at low temperatures. In other embodiments, an overshoe may include a removable, replaceable sole, or bottom sole portion, allowing a temperature damaged sole to be replaced. Furthermore, in both hot an cold environments, the overshoe may be formed from materials which have a relatively low thermal conductivity.

Figure 18:
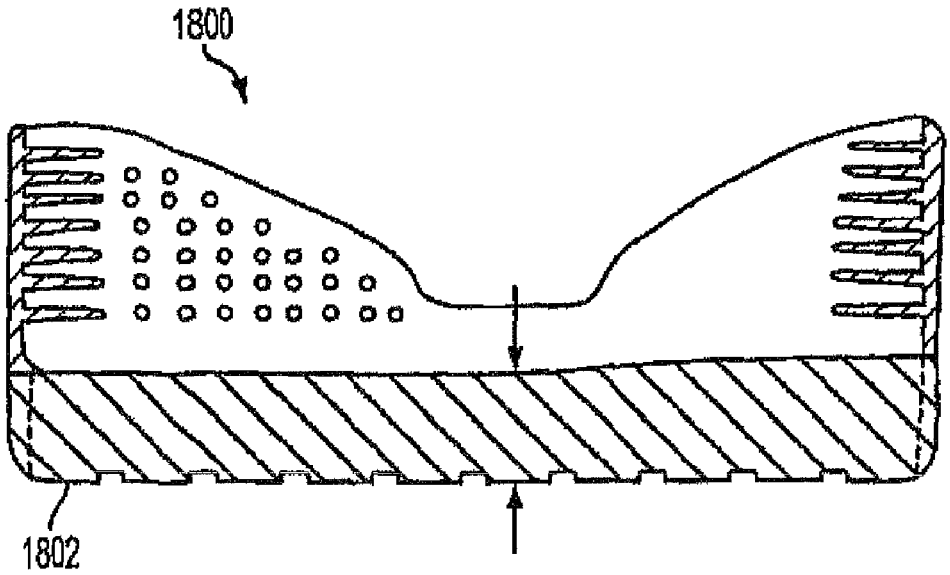
FIG. 18 depicts, in cross-sectional view, an embodiment of an overshoe consistent with the disclosure having enhanced cushioning.

Turning to FIG. 18, an overshoe 1800 may provide an enhanced cushioning effect. Such an overshoe 1800 may include sole portion 1802 providing a shock absorbing or cushioning effect. Such an embodiment, may be useful for sporting applications, military use, etc. According to one embodiment, the cushioning effect of the sole 1802 may be achieved by providing the sole having a relatively thick layer of foam, or similar cushioning material. The sole may also include chambers filled with a compressible medium, such as a gas. In other embodiments, the sole 1802 may include resiliently deformable features, such as collapsible ribs, etc., which may resiliently deform to absorb a shock or force on the overshoe 1800.

Figure 19:
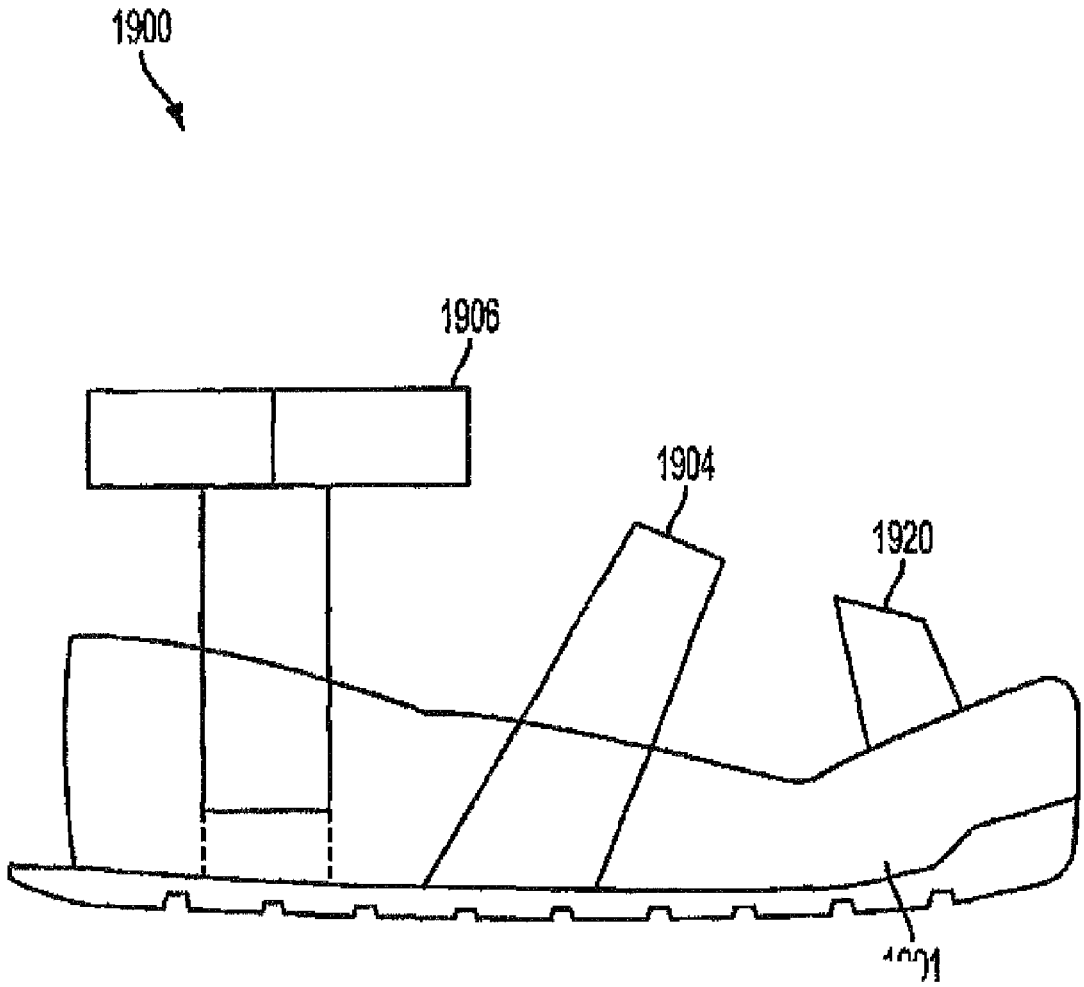
FIG. 19 is another embodiment of an overshoe consistent with the disclosure having enhanced retention.

FIG. 19 depicts an embodiment of an overshoe 1900 capable of being securely attached to a user's footwear structure. The ability to securely attach the overshoe 1900 may be beneficial for use during active endeavors, such as athletic activities, use in, or around, water, during rigorous physical activities, etc. As shown, the overshoe 1900 may include an overshoe base 1901 having one or more securement straps 1902, 1904, 1906 which may securely attach the overshoe 1900 to a user's footwear structure, leg, etc. The securement straps 1902, 1904, 1906 may include fasteners, such as hook and loop fasteners, pressure sensitive adhesive, buckles, etc., capable of releasably securing the overshoe 1900 for use. The securement straps 1902, 1904, 1906 may be web straps, fabric strips, plastic strips, etc., and may be integrally formed with the overshoe base 1901 or may be attached to the overshoe base, as by sewing, adhesive bonding, buckles coupled to the overshoe base, etc. In the illustrated embodiment, securement straps are arranged to be disposed across a toe portion 1902, and instep portion 1904, and around the ankle 1906. Other strap configuration may also suitable be employed without limitation.

The securement straps 1902, 1904, 1906 may be used alone to secure the overshoe to a footwear structure, or foot. Additionally, the securement straps 1902, 1904, 1906 may be used in combination with any of the securement features, such as the resilient protrusions, etc., disclosed in connection with any of the other embodiments disclosed herein. It should be appreciated that, when used with other securement features, the number of securement straps necessary to achieve an adequate attachment of the overshoe may be reduced.

Various additional features may be employed in connection with an overshoe herein. In the context of a work environment, the overshoe may be provided with protective features in the interest of safety. For example an overshoe may include a reinforced toe portion, similar to a reinforced toe on a work boot. Such a protective toe portion may be formed from a metal, e.g., a steel toe, as well as composite materials, which may combine the protective nature of the reinforced toe with a lightweight feature. Similarly, an overshoe may include a protective plate in at least a portion of the sole. The protective plate may protect against, for example, punctures from exposed nails or the like. As with the reinforced toe, the protective plate may be a metal component or may be formed from a plastic or composite material. The reinforced toe and the protective plate may be provided as integral features of the overshoe, or may be provided as add-ons, which may be selectively attached or coupled to an overshoe.

Overshoes herein may be formed from a variety of materials, yielding different characteristics. One embodiment may be formed from a material which may be sterilized, for example in an autoclave. The ability to sterilize the overshoe may allow the overshoe to be used in a medical environment or when working with contaminants, such as during environmental clean-up. Sterilizing the overshoe may obviate the expense of packaging and shipping the overshoe in a sterile condition, and may allow the overshoe to be reused after contamination rather than necessitating disposal after contamination.

Overshoes may include various other features which may universally applicable, or may be especially suited to particular uses. For example, an overshoe which may be used at night or in a dark environment may be provided with lights. The lights may either be configured to identify or locate the overshoes or wearer, or may be configured to provide illumination of the path or area around the wearer. In either configuration a variety of lights may be used. For example, incandescent lights, LED's, etc. may be used to provide illumination. The lights may be powered by a batter, or batter pack, associated with the overshoe, or may be powered through a power feed or wire from a remote location.

In summary, there is provided an overshoe including a base and at least one upstanding portion extending around at least a portion of the base. The overshoe may further include at least one protrusion extending inwardly from the upstanding portion for releasably retaining a footwear structure.

According to another aspect, there is provided an overshoe having a base including a first upstanding portion adjacent a front of the base and a second upstanding portion adjacent a rear of the base. The overshoe may also include at least one protrusion extending inwardly from at least one of the first upstanding portion or the second upstanding portion. The at least one protrusion may be capable of releasably retaining a footwear structure.

According to another aspect, there is provided a method of protecting a walking surface. The method may include providing an overshoe having a base and an upstanding portion extending around at least a portion of the base. The overshoe may further include at least one protrusion extending inwardly from the upstanding portion. The method of protecting the walking surface may further include disposing a footwear structure relative to the overshoe to resiliently deform the at least one protrusion.

The present disclosure sets forth a variety of embodiments, having various features and aspects. It should be appreciated that while the individual embodiments as shown having particular features, such features an aspects of the individual embodiments may be adapted for use with, or in combination with, the features and aspects of the various other embodiments herein. Accordingly, this disclosure is intended to contemplate such combinations of features from the several embodiments.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

What is claimed is:

1. An overshoe for use with a footwear, said overshoe comprising:

a base having a proximal end and a distal end;

an upstanding portion extending generally upwardly and away from and along an entire periphery of said base, said upstanding portion defining a front end adjacent said distal end of said base and a rear end adjacent said proximal of said base and lateral and medial sides disposed between said front and rear ends; and a plurality of resilient protrusions connected to and extending away from an inner surface of a respective one of said lateral and medial sides and an inner surface of at least one of said front and rear ends of said upstanding portion, said plurality of protrusions configured to generally retain said footwear to said overshoe when said footwear is received within said overshoe, wherein each of said plurality of resilient protrusions are spaced apart both vertically and horizontally with respect to one another.

2. The overshoe of claim 1, wherein a portion of said front end of said upstanding portion extends over a portion of said distal end of said base.

3. The overshoe of claim 1, further comprising a tab extending generally outwardly from said overshoe to assist with the removal of said footwear from said overshoe.

4. The overshoe of claim 3, wherein said tab extends generally outwardly from said base.

5. The overshoe of claim 3, wherein said tab extends generally outwardly from said upstanding portion.

6. The overshoe of claim 1, wherein said base, said upstanding portion, and said plurality of protrusions are formed as a single piece.

7. The overshoe of claim 6, wherein said base, said upstanding portion, and said plurality of protrusions are integrally molded.

8. The overshoe of claim 2, wherein said portion of said front end comprises a forefoot strap.

9. The overshoe of claim 8, wherein said forefoot strap comprises an adjustable strap configured to adjust the size of said forefoot strap to accommodate footwear of differing shapes and sizes.

10. The overshoe of claim 1, further comprising an expansion zone configured to allow a portion of said overshoe to resiliently expand and contract.

11. The overshoe of claim 10, wherein said expansion zone comprises a bellow wall.

12. The overshoe of claim 11, wherein said bellow wall is integrally formed into said overshoe.

13. An overshoe for use with a footwear, said overshoe comprising:

a base having a proximal end and a distal end;

an upstanding portion extending generally upwardly around a periphery of said base, said upstanding portion defining a front end adjacent said distal end of said base and a rear end adjacent said proximal of said base and lateral and medial sides disposed between said front and rear ends, wherein a portion of said front end of said upstanding portion defines a toe well, said toe well defining a cavity extending over a portion of said distal end of said base, said toe well configured to receive a portion of a footwear structure toe of said footwear, said upstanding portion tapers from said toe well to said proximal end of said base to provide a shallow upstanding portion at said rear end of said upstanding portion, said shallow upstanding portion having a reduced height compared to a height of said toe well; and a plurality of resilient protrusions spaced apart both vertically and horizontally with respect to one another, at least some of said plurality of protrusions being connected to extending away from an inner surface of a portion of a respective one of said lateral and said medial sides of said upstanding portion, wherein said shallow upstanding portion allows sliding insertion of said footwear structure toe into said toe well and said plurality of resilient protrusions are configured to generally retain said footwear to said overshoe when said footwear structure toe is received within said toe well.

14. The overshoe of claim 13, wherein some of said plurality of protrusions are connected to and extend away from an inner surface of said front end of said upstanding portion.

15. The overshoe of claim 14, wherein some of said plurality of protrusions extend downwardly from said toe well.

16. The overshoe of claim 13, further comprising a tab extending generally outwardly from said upstanding portion along a longitudinal length of said overshoe to assist with the removal of said footwear from said overshoe.

17. The overshoe of claim 13, further comprising an expansion zone comprising a bellow wall configured to allow a portion of said overshoe to resiliently expand and contract.

18. The overshoe of claim 13, further comprising:

a tab extending generally outwardly from said upstanding portion along a longitudinal length of said overshoe to assist with the removal of said footwear from said overshoe; and an expansion zone comprising a bellow wall configured to allow a portion of said overshoe to resiliently expand and contract, wherein said base, said upstanding portion, said plurality of resilient protrusions, said tab, and said expansion zone are formed as a single piece.

19. A footwear system comprising:

a footwear comprising a sole and an upper extending over a portion of said sole, said upper configured to retain a user's foot to said footwear; and an overshoe comprising:

a base having a proximal end and a distal end;

an upstanding portion extending generally upwardly around a periphery of said base, said upstanding portion defining a front end adjacent said distal end of said base and a rear end adjacent said proximal of said base and lateral and medial sides disposed between said front and rear ends, wherein a portion of said front end of said upstanding portion defines a toe well, said toe well defining a cavity extending over a portion of said distal end of said base, said toe well configured to receive a portion of said upper of said footwear, said upstanding portion tapers from said toe well to said proximal end of said base to provide a shallow upstanding portion at said rear end of said upstanding portion, said shallow upstanding portion having a reduced height compared to a height of said toe well; and a plurality of resilient protrusions spaced apart both vertically and horizontally with respect to one another, at least some of said plurality of protrusions being connected to extending away from an inner surface of a portion of a respective one of said lateral and said medial sides of said upstanding portion, wherein said shallow upstanding portion allows sliding insertion of a portion of said upper of said footwear into said toe well and said plurality of resilient protrusions are configured to generally retain said footwear to said overshoe when said portion of said upper of said footwear is received within said toe well.

* * * * *